United States Patent [19]

Reed

[11] 3,972,521

[45] Aug. 3, 1976

[54] BINDERY SYSTEM CAPABLE OF TESTING ITS OWN INSPECTION AND CONTROL DEVICES

[75] Inventor: David A. Reed, Easton, Pa.

[73] Assignee: Harris Corporation, Cleveland, Ohio

[22] Filed: Feb. 28, 1975

[21] Appl. No.: 554,154

[52] U.S. Cl. ..... 270/58

[51] Int. Cl.[2] ..... B65H 39/055

[58] Field of Search ..... 270/54–58; 271/91, 252–265; 73/159

[56] References Cited

UNITED STATES PATENTS

| | | | |
|---|---|---|---|
| 3,519,264 | 7/1970 | Beacham | 270/54 X |
| 3,825,246 | 7/1974 | Elia et al. | 270/54 X |

*Primary Examiner*—Edgar S. Burr
*Assistant Examiner*—A. Heinz

[57] ABSTRACT

A collating apparatus for assembling a magazine from a plurality of signatures has a conveyor movable successively through a plurality of signature feeding stations and includes feeder sensors for sensing malfunctions of each feeding station. A rejection station following the last signature feeding station rejects magazines for which any of the feeder sensors sensed a malfunction. Another sensor at an inspection station following the rejection station senses the presence or absence of a magazine and compares the results with a malfunction-data record to monitor the performance of the rejection station. After a predetermined number of magazines have been assembled, a test of the operability of all of the sensors is automatically conducted by inhibiting the feeding of signatures and detecting whether or not every sensor properly senses the intentionally produced fault.

13 Claims, 6 Drawing Figures

BINDERY SYSTEM CAPABLE OF TESTING ITS OWN INSPECTION AND CONTROL DEVICES

BACKGROUND OF THE INVENTION

The present invention relates to bindery systems having a plurality of hoppers or feed stations at which signatures are fed to a conveyor, and is an improvement in such bindery system. For example, the invention is an improvement in a bindery system disclosed in U.S. Pat. application Ser. No. 141,331, filed May 7, 1971. In that system various magazines or books composed of various predetermined combinations of signatures are made in accordance with various subscriber information under the control of a computer. On the basis of information read from a magnetic tape, the computer instructs different ones of the signature feed stations to feed or not to feed to provide differently constituted magazines for different subscribers. At each feed station, the performance of the feeder in properly adding one signature is sensed by a sensor, and a malfunction code is generated when the sensor detects that the feeder does not operate properly. The malfunction code is shifted through a shift register to simulate the movement of the defective magazine through the remaining stations of the gatherer to a reject station and the magazine is rejected when it arrives at the reject station.

SUMMARY OF THE INVENTION

The present invention is a bindery system having a plurality of feed stations at which signatures are added to a conveyor, and involves methods and apparatus for automatically testing various inspection devices that are associated with the bindery system, to indicate whether or not the inspection devices are inspecting properly.

For purposes of illustration a particular type of bindery system is described as an example of the uses of the invention. At each feed station of a typical collating apparatus, malfunctions of the feeder are detected by one or more sensors, the types of detectable malfunctions preferably including a miss, which is a failure to feed a signature. The collating apparatus may include a reject gate following the last feed station, to reject a defective magazine when a conveyor chain space which the defective magazine occupies arrives at the reject gate.

At a station beyond the reject gate, another sensor automatically inspects for presence or absence of a magazine. If the reject gate malfunctioned by failing to reject a defective magazine, that failure to reject stops the collating apparatus immediately. Similarly, if the reject gate malfunctioned by rejecting a magazine which was not defective, that malfunction of the reject gate also stops the collating apparatus immediately.

The present invention automatically produces an intentional simulated fault periodically, for example once for each 500 magazines, and monitors the responses of the sensors and of certain other equipment. If the sensors fail to sense the intentional fault, display devices inform the operator.

Accordingly, in one aspect of the invention a bindery system is provided having a conveyor for producing a book composed of a plurality of signatures, in which a production device ordinarily performs a function and an inspection device senses whether or not that function was performed, and the bindery system automatically monitors itself by occasionally commanding the production means not to function, as a test, and then observing the results of the inspection by the inspection device to see whether or not it detected the fact that the production means did not function.

In another aspect of the invention, a bindery system provided in which a signature feeder for feeding a signature onto a conveyor during routine production is intentionally inhibited automatically once in a while as a test, and the behavior of a feed-sensing means is automatically observed. If the feed sensing means fails to detect the intentional fault thus introduced as a test, that failure is indicated.

In still another aspect of the invention a bindery system is provided in which, following a collator on a conveyor, an inspection station is provided for sensing and indicating when a book is absent from the conveyor, and means are provided to command the machine to cause an occasional absence of a book, and the performance of the inspection station is automatically monitored to ascertain whether or not it responds appropriately to the absence of the book.

Other aspects and features of the invention are also described in the specification, claims, and figures.

DESCRIPTION OF PREFERRED EMBODIMENTS

In a first preferred embodiment of the invention, shown in FIGS. 1, 2A, 2B, 3 and 4, a collating machine for assembling magazines and books from a plurality of signatures is arranged to be controlled by a programmable controller which in turn is under the direction of a digital computer so that the machine can provide different combinations of signatures for different subscribers. The collating machine is a portion of a bindery system that includes a binder and a trimmer (not shown). The computer 10 (FIG. 3) is preferably programmed in advance, after which it receives subscriber data from a reel of magnetic tape or other source of input information. The magnetic tape contains data describing the particular different combinations of signatures which are to be employed by the collating machine 14 (FIG. 1) to form a magazine tailored differently for various subscribers and groups of subscribers.

Figure 2A:
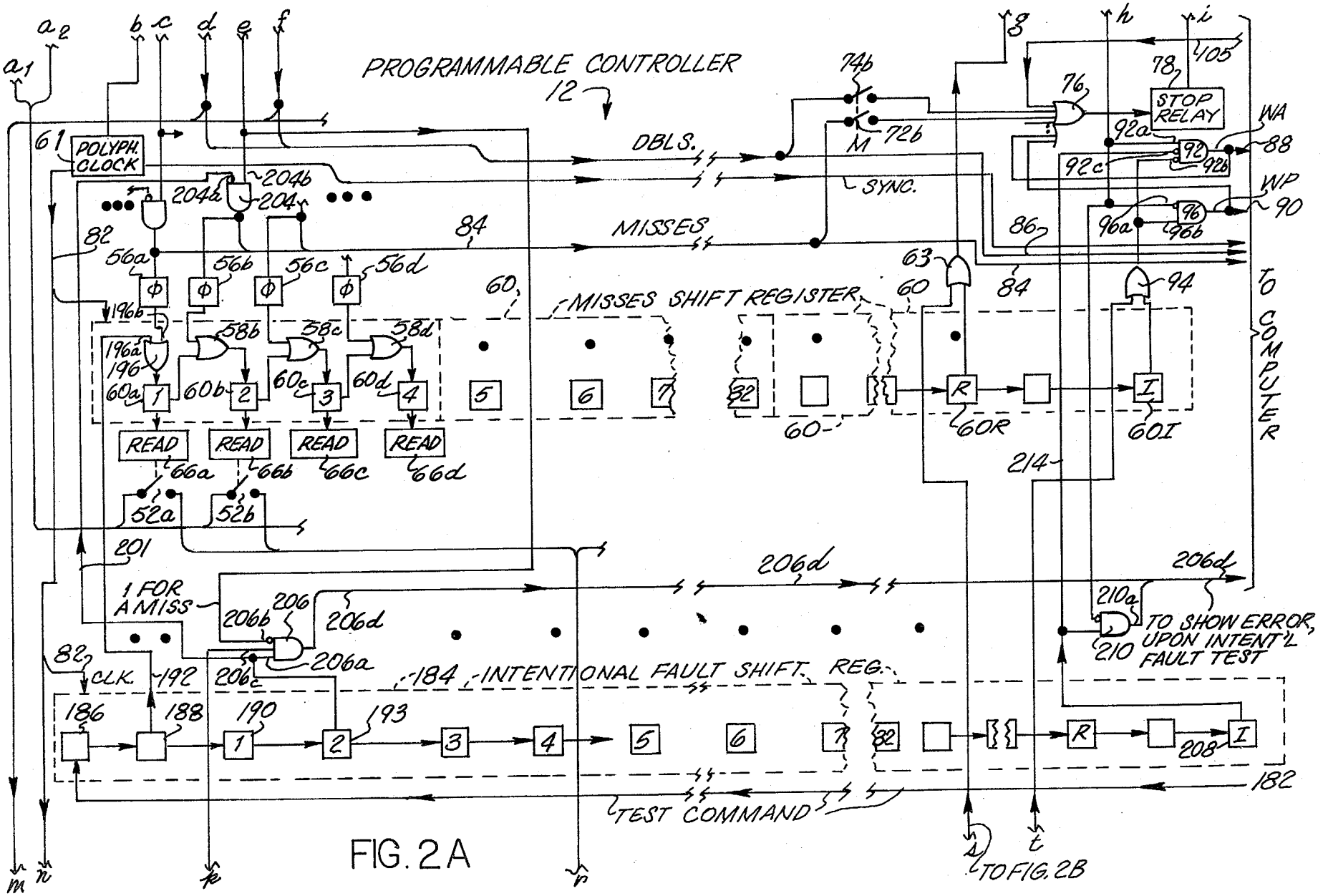
FIGS. 2A and 2B together are a block diagram of a programmable controller which receives instructions from a computer and which controls the collating machine of FIG. 1.
Figure 2B:
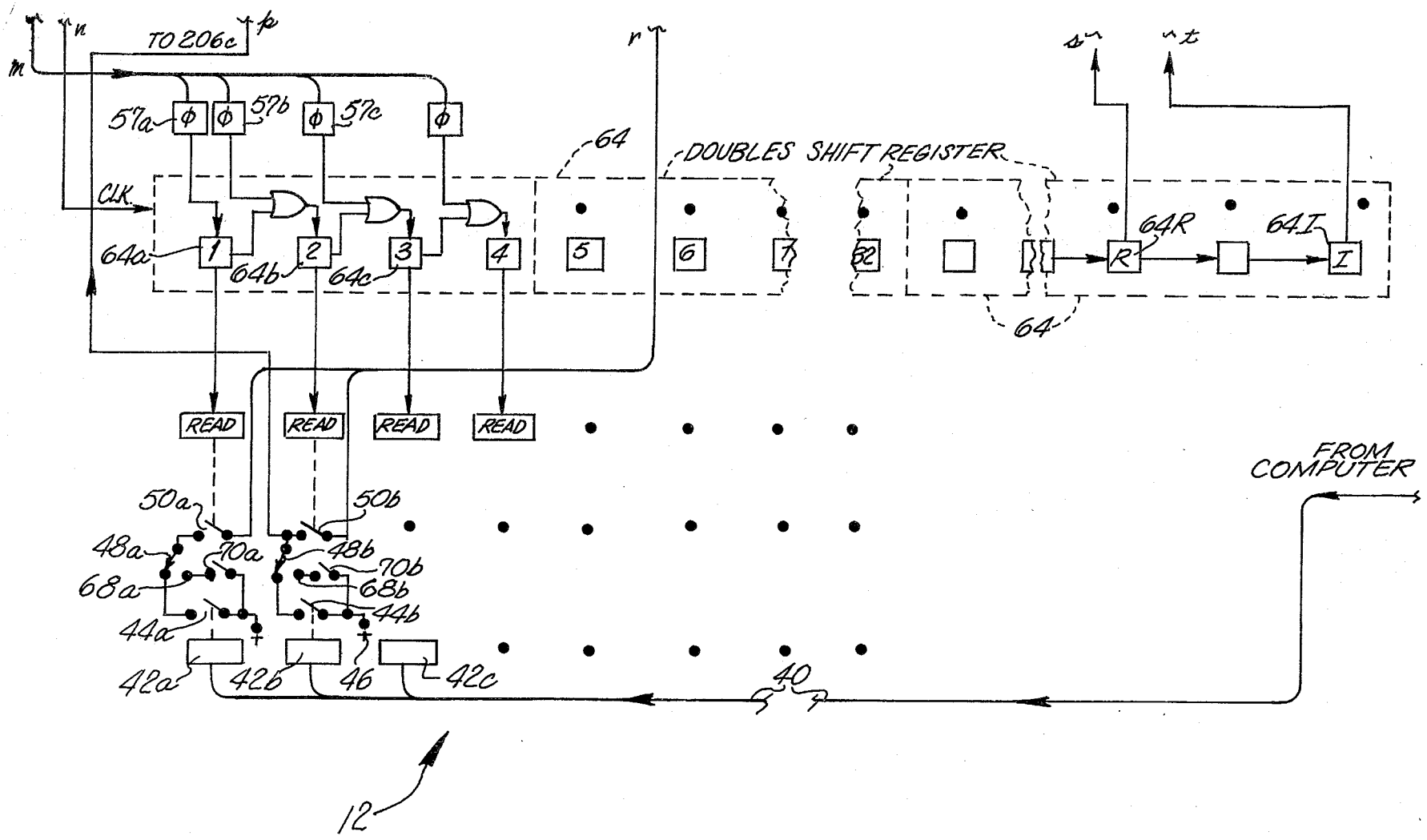

The computer 10 does not operate directly upon the collating machine 14, but instead issues its instruction and receives information back from the programmable controller 12, (FIGS. 2A and 2B). The programmable controller 12 implements the instructions issued by the computer 10 to control the collating machine 14 as well as the binder and trimmer, to produce the various desired types of magazines. In this way, a magnetic data tape file containing subscriber data indirectly controls the collating machine 14 to produce the desired magazines.

Figure 1:
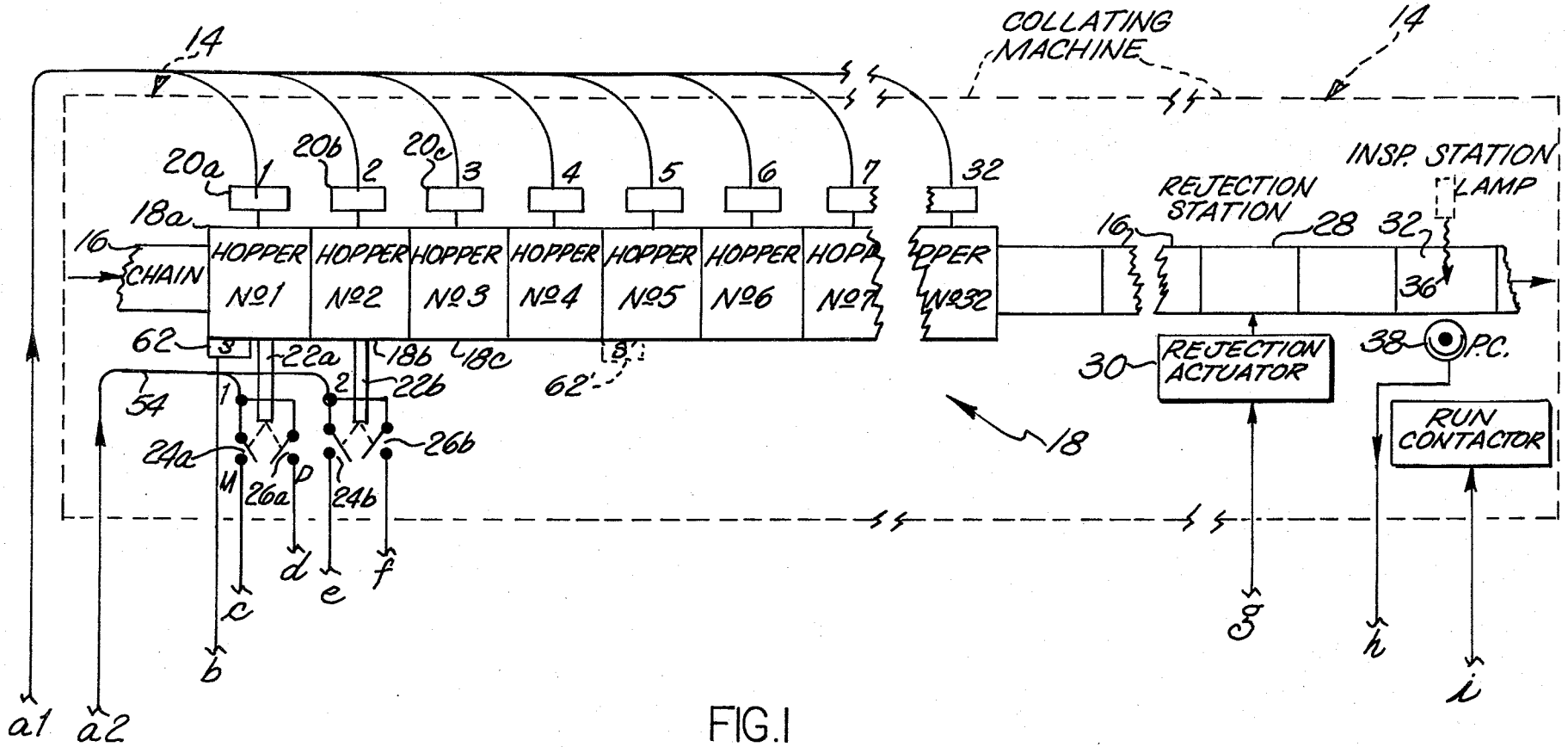
FIG. 1 shows a portion of a collating machine including a conveyor, a plurality of signature feeding stations, a rejection station, and an inspection station.

The collating machine 14 has a conveyor chain 16 onto which different signatures are fed from hoppers to form a desired magazine, after which any defectively formed magazines are rejected at a rejection station being monitored at a subsequent inspection station. As shown in FIG. 1, the conveyor chain 16 is divided longitudinally into chain spaces, each of which is large enough to accomodate a magazine to be assembled on the chain space. The conveyor chain 16 moves through a plurality of feed stations. A signature feeder is located at each feed station. The number and construction of the feeders may vary, but preferably they are as shown in U.S. application Ser. No. 339,144, filed Mar. 8, 1973, now U.S. Pat. No. 3,825,247, and assigned to the assignee of the present invention. That disclosure is incorporated herein by reference.

In general, each feeder includes, as is well known, a hopper which contains a supply of signatures. The signatures are removed from the hopper by a suitable mechanism which includes a suction device which withdraws an edge of a signature downwardly into a position where it can be gripped by a gripper which is carried on a rotatable drum. The gripper, once it grips the signature, carries the signature with the drum to release location where the signature is released for deposit into the chain space.

In the particular embodiment being described there are thirty-two hoppers 18*a*, 18*b*, etc., for feeding signatures onto the chain. Each of the hoppers 18*a*, 18*b*, etc., has a supply of signatures which differ among hoppers, and each hopper is capable of feeding one signature at a time onto the chain 16 when a respective feed device 20*a*, 20*b*, 20*c*, etc., of the hopper is actuated.

Each hopper has a respective caliper means 22*a*, 22*b*, etc., for measuring the thickness of a signature which is fed during each machine cycle. The caliper device actuates a first switch called the miss switch 24*a*, 24*b*, etc., if no signature is fed, and it actuates a second switch 26*a*, 26*b*, etc., if two or more signatures are fed. Under some circumstances, but not all, an abstention from feeding represents a malfunction, so that actuation of the miss switch 24 may indicate a malfunction. Actuation of the doubles switch 26 always indicates a malfunction of a signature feeder.

Each chain space, as it comes out of the last stage of the gatherer 18, carries a magazine. Some of the magazines are defective, as indicated by information obtained from the miss switches 24 and the doubles switches 26. When a defective magazine reaches a rejection station 28, it is removed from the conveyor chain 16 by the operation of a rejection actuator 30 which is under the control of the programmable controller 12. At the rejection station a suitable means is provided for rejecting the defective magazines. Details of the mechanism are not described herein, since any known rejection structure can be utilized.

At a later station 32, each chain space is inspected for the presence or absence of a magazine in order to monitor the performance of the rejection station 28. The inspection station 32 includes a lamp 34 projecting a beam of light 36 across a chain space to a photocell 38, which receives light if and only if a magazine is absent from the chain space. The inspection station 32 supplies a signal to the programmable controller 12 which stops the collating apparatus immediately upon a malfunction of the rejection station and which provides information to the computer 10 for counting wrongful absences of magazines and for counting wrongful presences of magazines at the inspection station 32, that is, for counting both types of errors which could occur at the rejection station 28.

In this way, the collating machine 14 selectively feeds signatures at a plurality of hoppers onto a conveyor chain 16, with the misses and double feeding of signatures detected at each hopper by a caliper; defective finished magazines are rejected at a rejection station 28, and the performance of the rejection station 28 is monitored at the inspection station 32.

In the first preferred embodiment the programmable controller 12, FIGS. 2A,2B, performs many functions. It stores data describing the pattern of signatures which are to be fed at the various hoppers, receives malfunction data from the caliper switches 24, 26 and shifts that data through shift registers 60, 64 to simulate movement of the books through the collating machine 14, issues reject signals to the rejection station 28, and receives data from the inspection station 32 for retransmission to the computer 10. Moreover, in the present invention the programmable controller 12 occasionally receives an intentional test command from the computer 10, and shifts that command through a shift register 184 to test the feeder inhibit apparatus and the inspection apparatus.

Binary data specifying which hoppers should feed signatures for producing a particular type of magazine for one particular subscriber or group of subscribers is received by the programmable controller 12 on data lines 40 and stored in latching relays 42*a*, 42*b*, 42*c*, etc. corresponding respectively to the hoppers 18*a*, 18*b*, 18*c*, etc. If a signatures is to feed at, for example, hopper 18*b*, a pair of contacts 44*b* of the relay 42*b* is placed in a closed position and they connect a voltage from a voltage supply 46 to the feeder actuator 20*b* of hopper 18*b* through a chain of switch and relay contacts 48*b*, 50*b*, 52*b*, whose various individual functions are described below. If all of the contacts 48*b*, 50*b*, 52*b* are closed, the actuator 20*b* causes a signature to feed at the station 18*b* onto the conveyor chain 16. When an intentional test is performed the relay contacts 52*b* are open and a signature does not feed.

Signals on the cable *a*1, FIGS. 1 and 2, actuate the feed devices 20*a*, 20*b*, 20*c*, etc., to feed or not to feed a signature, using mechanisms and methods that are well-known in the prior art. One such known method of controlling feeding, for example, is to turn a vacuum suction system on or off at the hopper at a proper time to pick up a signature or not to pick up a signature for feeding.

Voltages applied to the various conductors of a multiple-conductor cable 54 on a line *a*2 of FIGS. 1 and 2 serve to enable and disable the miss switches 24 and the doubles switches 26 of FIG. 1. In this way, the miss switches and doubles switches are selectively controlled to prevent them from generating a reject signal when a hopper is intentionally inhibited from feeding a signature.

If the signature feeds properly, the caliper 22*b* does not actuate either the miss switch 24*b* or the doubles switch 26*b*. If the signature does not feed at all, however, the caliper 22*b* closes the contacts of the miss switch 24*b*. This connects an electrical signal, which was received from one of the switches 52 on the cable 54 if the hopper was programmed to feed, through the miss switch 24*b*, and from there through a phase delay device 56*b* and an OR gate 58*b*, into a second stage 60*b* of a shift register 60 which keeps track of the miss signals. The miss signal which is thus introduced into stage 60*b* is transmitted to the next succeeding stage 60*c* upon the next machine cycle, the machine cycle being indicated by a pulse produced by a synchronizer 62 and a polyphase slaved clock 61, which shifts the shift register 60. The synchronizer 62 is a sensing device which produces one output pulse signal for each machine cycle of the collating machine 14. When it is being shifted, the malfunction signal in stage 60*b* passes through an OR gate 58*c* into the stage 60*c* of the shift register 60. The shifting is repeated cyclically. All strobe signals are omitted from the diagrams because they are routine.

When the malfunction signal arrives at a later station 6OR of the shift register 60, the defectively produced magazine which resulted from the misfeed at station 18*b* is located at the rejection station 28, and the rejection actuator 30 is actuated by the malfunction signal in stage 6OR, which is communicated to the rejection actuator 30 through an OR gate 63. Thereupon, the defective magazine is removed from the conveyor chain 16 by the rejection actuator 30.

The malfunction signal remains in the shift register 60, and upon the second following machine cycle, the malfunction signal is in a stage 60I, where it is available for comparison with photocell data received from the inspection station 32. No magazine should then be present at the inspection station 32 if the rejection station 28 properly rejected the defective magazine two cycles earlier.

In a similar manner, when a feeder feeds two signatures instead of one, the malfunction is detected by a caliper and entered as a code signal into another shift register 64, which thereafter shifts the malfunction code signal to successive stages of the register 64 upon subsequent machine cycles. The code signal later arrives at a stage 64R, where it is capable of actuating the rejection actuator 30 through the OR gate 63. Two machine cycles later, the malfunction code is in a stage 64I of the register 64. The presence of a malfunction code in the stage 64I should coincide with the absence of a magazine at the inspection station 32, because the reject station 28 should have removed the defective magazine. Further description of the operation of the inspection station 32 is provided hereinbelow.

When a malfunction of a hopper feeder occurs, the downstream hoppers are prevented from feeding signatures onto the particular chain space which carries the defective magazine. This downstream shutoff of feeders is accomplished by the relay contacts, for example, the contacts 50*b*, 52*b*, FIG. 2. The contacts 52*b* are actuated to an open position by a register read device 66*b* when the respective shift register stage 60*b* contains a logic 1 signal, which indicates that a defective book is then present at the hopper 18*b*. The open relay contacts 52*b* prevent the actuator 18*b* from operating in the current machine cycle, so that no signature is fed onto the defective magazine at hoppers downstream from a hopper where the malfunction occurred. The relay contacts 50*b* perform a similar function for double-feed malfunctions of an upstream hopper by opening in response to the presence of a malfunction code signal in the stage 64*b* of the doubles shift register 64.

If it is desired to operate one or more hoppers under the control of a manual switch instead of the computer 10, a manual-or-automatic selector switch 48*a*, 48*b*, 48*c*, etc., is first actuated to its manual position. For example, switch 48*b* would be actuated to a position 68*b*. The hopper 18*b* is thereafter controlled to feed or not to feed in accordance with whether a manual switch 70*b* is closed or open, the switch 70*b* substituting for the relay contacts 44*b*.

Preferably, the switch 70*b* has two other pairs of contacts 72*b* and 74*b*, shown at the top of FIG. 2A, which, when closed, connect the fault signals from the miss switch 24*b* and the doubles switch 26*b* to an OR gate 76 whose output actuates a stop relay 78. The stop relay 78 interrupts a run contactor 80 to stop the machine upon the first occurrence of either a misfeed or a double feed fault at hopper 18*b*, or indeed at any hopper at which the manual-or-automatic switch 48 is in the manual position.

Other embodiments of these switching circuits are readily devised and have been used in the prior art. For example, the occurrence of two successive faults at a particular hopper can stop the collating machine 14 when a respective manual-or-automatic switch 48 is in the manual position, which could be termed the "standard" position. If desired, the switch contacts 72*b*, 74*b* may be arranged to be operated independently of the manual-or-automatic switch 48.

In a first portion of each machine cycle, both the miss shift register 60 and the doubles shift register 64 are read, and their corresponding switching relay contacts 52, 50 are set in positions in accordance with the data in those shift registers. Also, the hopper feeders 18*a*, 18*b*, etc. are actuated, and the misses and doubles switches 24, 26 are operated to produce new fault data if a malfunction occurs. In a later portion of the same machine cycle, following a phase delay introduced by the phase delay devices 56, 57, the new fault data from the switches 24, 26 are entered into the respective shift registers 60, 64, following which the data in those shift registers are shifted to the next succeeding stage in response to a pulse on a line 82 from the slaved polyphase clock 64.

Fault signals from the miss switches 24 and from the doubles switches 26 are also transmitted, over cables 84, 86 respectively, from the programmable controller 14 to the computer 10, where the faults are counted in a manner to be described hereinbelow.

If desired, the gatherer 18 may be divided into sections having four hoppers per section, with a different synchronizer 62 for each section, and with the various sections mechanically driven out of phase with each other to distribute the torque load on a driving motor more uniformly throughout a machine cycle. The techniques involved in using more than one synchronizer are known in the prior art.

The inspection station 32 of FIG. 1 cooperates with portions of the programmable controller 12 to produce an output pulse at an output line 88 of FIG. 2 whenever a magazine should be present but is not present at the inspection station, for use by the programmable controller 12 to stop the collating machine 14 immediately, and for use by the computer 10. The computer counts these occurrences, which can be due to a malfunction of the rejection station 28. The inspection station 32 also produces an output pulse at another output line 90 of FIG. 2 when a magazine in present at the inspection station 32 which should have been rejected at the rejection station 28, which also stops the collating machine 14 and is counted.

The wrongful absence signals at the output line 88 are produced by the output of a logic gate 92 when one of the gate's input terminals 92*a* has a logic 1 signal indicating that the photocell 38 is receiving light in consequence of the absence of a signature at the station 32. Simultaneously, another input terminal 92*b* is receiving a logic zero signal, indicating that neither the stage 60I of the miss shift register 60 nor the stage 64I of the doubles shift register 64 contains a malfunction logic 1 signal. The signals from the stage 60I and 64I are combined in an OR gate 94 so that either could have, but did not, produce a logic 1 signal at the terminal 92*b*. The signal at terminal 92*b* is inverted and connected in a logic AND relationship with the signal at terminal 92*a*. Thus, if the shift registers 60 and 64 indicate that there is no defect at the chain position presently at the inspection station 32, and at the same time the inspection station photocell 38 indicates that the magazine has been removed from that chain station, a wrongful absence signal is produced at the output terminal 88 and transmitted to the computer 10 to be counted. The signal at the terminal 88 is also connected to the OR gate 76 to stop the collating machine 14. (Terminal 92*c* is discussed below.)

In a similar way, if a book is present at the chain station 32, thereby producing a zero logic signal at an inversion terminal 96*a* of a logic gate 96, and on the same machine cycle another terminal 96*b* of the logic gate 96 has a logic 1 signal indicating that one or both of the stages 60I, 64I is indicating a defective magazine at the chain space 32, a wrongful presence signal is produced on the line 90 for transmission to the computer 10 where it is counted. The signal on the line 90 is also connected to the OR gate 76 to stop the collating machine 14. The technique by which events are counted by the computer 10 is described hereinbelow following a general description of the main components of the computer.

The computer 10 includes an input/output interface unit 98, a memory unit 100, an arithmetic unit 102, and a control unit 104. Major communication routes between the units of the computer are shown in the greatly simplified block diagram of FIG. 3. The input/output interface unit 98 handles inputs and outputs of the computer 10 from any of a variety of sources and destinations. Program instructions are entered into the computer at a terminal 98*a* of block 98. Also certain parameter values, such as the maximum permissible number of misses per 1000 machine cycles for each hopper, and the maximum permissible number of double feeds per 1000 cycles of machine operation for each hopper, are entered at terminal 98*a* and stored in the computer's memory unit 100 before the collating machine 14 is started. After the computer has been thus programmed, subscriber data specifying the signatures to be used in forming magazines for a first group of subscribers is entered into the computer at terminal 98*a*, preferably from a magnetic tape file. Other sources of input data can be employed, of course, including punched paper tape, punched cards, or a manually operated keyboard instrument 200.

When a hopper error rate is found to be excessive, as further discussed below, the input/output interface unit 98 transmits a stop signal from the computer 10 to the programmable controller 12 on a line 105 to stop the collating machine 14. The input/output interface unit 98 also prints out information concerning the operation of the collating machine 14 on a teleprinter, which is a portion of the teletype unit 200. Other output devices which may be used include paper tape, punched cards, magnetic tape, bells, lights, etc.

The memory unit 100 stores program instructions for use by the control unit 104, data for use by the arithmetic unit 102, and instructions and data for use by the programmable controller 14. Preferably, the memory unit 100 is a random access storage device such as an array of toroidal magnetic cores which store binary data by being magnetized in either a clockwise or a counter-clockwise direction. The memory unit is preferably capable of storing more than 1000 words, each of which is 12 bits long, typically. Each word space of data storage is identified by an address so that data can be written into the space or read out of it by addressing that location.

The arithmetic unit 102 performs the computations that must be done by the computer. In the present invention, the counting of errors and the counting of machine cycles are performed by the arithmetic unit in cooperation with the memory unit. The principal component of the arithmetic unit is an accumulator which can accumulate partial sums during arithmetical computations and which, among other things, can count events such as malfunction-indicating pulses. To count, the computer reads the previously accumulated count from memory upon occurrence of an event to be counted, then increments that data by one unit, and transfers the new amount out of the accumulator and back into the memory unit for storage again in the same location from which the previous count was read.

The control unit 104 is a switching section which manages the operations of the computer 10. The control unit 104 withdraws programmed instructions in an orderly manner from the computer memory unit 100 and uses those instructions to control the arithmetic unit 102, the memory unit 100, and the input/output interface 98. The control unit 104 issues commands to the arithmetic unit 102 to tell it what to do and to tell it from what addresses in the memory unit it should obtain the data upon which it is to operate. When the arithmetic unit 102 has completed a task, the control unit 104 instructs the arithmetic unit as to what to do with the results, for example, to store the results in a particular address of the memory unit 100 for subsequent use.

Figure 4:
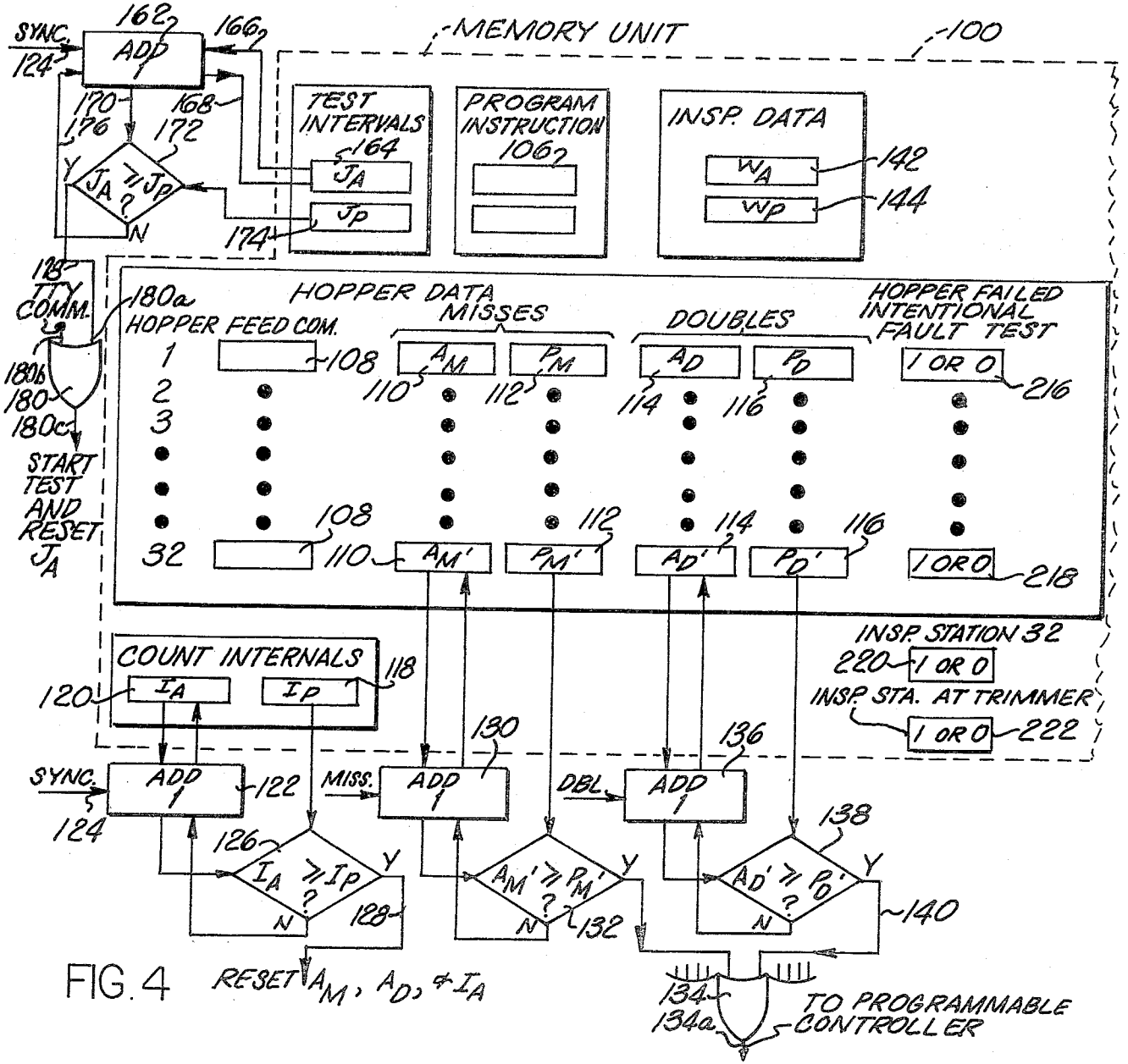
FIG. 4 is a symbolic block diagram showing a portion of a memory unit of the computer of FIG. 3 and some logic functions performed by the computer.

Some of the contents of the memory unit 100 are indicated symbolically in FIG. 4 for the first preferred embodiment. The contents includes program instructions stored in a group of storage location 106, each of which accomodates one word.

Hopper data that are stored in the memory 100 include feed commands stored in a group of memory locations 108. These particular core addresses 108 contain instructions to the hoppers 18, to control whether or not their feed devices 20*a*, 20*b*, 20*c*, etc. should feed a signature. Hence, the feed commands in the storage locations 108 specify the makeup of a particular type of magazine for a subscriber whose magazines are currently being assembled by the collating machine 14.

The hopper data also includes, in storage locations 110, the count of the number of miss malfunctions that have occurred thus far for each hopper in the current 1000-cycle interval. In FIG. 4, the number of misses for the first hopper is designated $A_M$ and the number of misses for the 32nd hopper is designated $A_M'$.

The maximum number of misses for any hopper, at which number the collating machine will be stopped, is stored for each hopper in storage addresses 112. This could be called the maximum fault rate per 1000 cycles for misses. The maximum number for hopper 1 is designated $P_M$, and for hopper 32, $P_M'$.

The numbers $A_M \ldots A_m'$ are reset to zero at the end of each 1000 machine cycles, although some number other than 1000 can be employed if desired.

The number of doubles malfunctions, that is the feeding of two or more signatures when only one should have been fed, is stored for each hopper in storage addresses 114. $A_D$ represents the number of doubles counted for hopper No. 1 since the start of the 1000 machine cycle interval which is currently in progress, and $A_D'$ similarly represents the number of doubles for hopper 32. The fault rate limit per 1000 cycles for double feeds is stored in storage locations 116 for each of the 32 hoppers, in the preferred embodiment. These numbers are denoted $P_D$ for hopper No. 1 and $P_D'$ for hopper No. 32. The fault rate limits may be different for different hoppers if desired.

Intervals within which the fault rate is determined are established and controlled by data in a "count intervals" portion of the memory unit 100. The number of machine cycles, for example, 1000, within which misses and doubles are to be counted before starting over at zero is stored in a memory address 118, labeled $I_p$. The number of machine cycles that have occurred thus far in a current 1000 cycle counting interval is stored in the memory location 120, the count being designated by $I_A$. Thus, for example, at a given instant $I_A$ may be 800 and $I_p$=1000, indicating that 800 machine cycles have occurred thus far in the current 1000 cycle counting interval. To continue the numerical example, the number of misses $P_M'$ which would stop the collating machine 14 for hopper No. 32 may be set at 3 and this would be stored in the hopper 32 address location 112. After 800 machine cycles in the present example, the number of misses $A_M'$ for hopper 32 may be 2. The number 2 is therefore stored in the address location 110. If, during the next 200 machine cycles, another miss should occur at hopper 32, the number $A_M'$ would then be increased to 3, and the collating machine 14 would be stopped, because the maximum fault rate limit $P_M'$ of 3 would have been reached. If, instead, no further misses should occur at hopper 32 within the next 200 machine cycles, the 1000 cycle interval would have come to an end and the count $A_M'$ would be reset to zero without reaching the limit $P_M'$ and therefore without stopping the collating machine 14.

The number of counts $I_A$ accumulated thus far during a count interval are counted by reading the number $I_A$ from the storage location 120, and adding 1 to that amount in a portion 122 of the arithmetic unit 102 upon occurrence of a synchronizing signal 124. After each addition of 1 to the count $I_A$, the new count is compared, as indicated by a block symbol 126 of FIG. 4, with the programmed interval length $I_p$. If $I_A$ does not as yet equal $I_p$, the new value of $I_A$ is written back into the storage location 120 to await the next sync signal 124. If, instead, the number $I_A$ has been increased to the point that it equals $I_p$, the block 126 produces a signal 128 to reset $I_A$, that is to write a zero into the memory location 120. The signal 128 also resets to zero all 32 of the miss counts $A_M \ldots A_M'$ in the storage registers 110, and resets to zero all of the doubles counts $A_D \ldots A_D'$ in the storage locations 114.

Upon occurrence of a miss signal on one of the lines 84 of FIG. 2, the miss count in the storage register 110 for the corresponding hopper is increased by a count of 1. For example, a miss at hopper 32 causes the computer to withdraw the number $A_M'$ from its storage location and to increment it by 1 unit as shown in block 130 of FIG. 4. The increased value of $A_M'$ is then compared in a comparator block 132, which is part of the arithmetic unit 102, with the stored fault rate limit $P_M'$ for the hopper 32. If the fault rate limit has not been reached as yet, the new value of $A_M'$ is written back into the storage register 110 for hopper 32. If, however, the fault rate limit has been reached, a signal is transmitted from the circuit 132 to and OR logic function portion 134 of the computer 10. An output signal **134*a* from portion 134 is connected to the OR logic device 76 in the programmable controller, FIG. 2, to actuate the stop relay 78 and interrupt the run contactor 80 to stop the collating machine 14**.

In the same way, when a doubles malfunction occurs, for example for hopper 32, the count $A_D'$ in a storage register 114 is read from the memory 100 and incremented in a unit 136 by 1 count. The new count is compared in a comparator program 138 with the fault rate limit $P_D'$ for that hopper, and if the fault rate limit has been reached, a signal 140 is applied to the OR function device 134 to stop the collating machine 14.

In this way, the computer operates to count the number of faults of each type, that is, misses or doubles, and to stop the collating machine 14 if any of the malfunction counts reaches a maximum permissible value which is stored in the memory unit 100 of the computer 10.

The number of wrongful absences WA detected at the inspection station 32 is stored in a memory address 142 of the computer memory, from which it can be accessed upon command for reading by an operator. The number of wrongful presences WP is similarly stored, in a memory location 144, FIG. 4. The WA and WP counts can be reset to zero by a signal on the line 128 if desired, or can instead be reset by a manually initiated reset command.

When it is desired to test the bindery machine by introducing an intentional fault in the product once for each 500 cycles of operation, the number 500 is stored in a location 174 of the memory unit 100. The number thus stored in this example 500, is designated $J_P$ in FIG. 4. An add-1 logic circuit 162 and some other logic components of FIG. 4 constitute a partial flow chart of functions that are performed by the computer 10. One such function is the counting of machine cycles for the purpose of initiating an intentional fault test once for each 500 magazines produced.

Another number $J_A$ represents the number of magazines produced thus far during a count interval; they are counted by reading the number $J_A$ from a storage location 164, and adding 1 to that amount in the portion 162 of the arithmetic unit 102 upon occurrence of a synchronizing signal 124. After each addition of 1 to the count $J_A$, the new count is compared, as indicated by a block symbol 172 of FIG. 4, with the programmed interval length $J_p$. If $J_A$ does not as yet equal $J_p$, the new value of $J_A$ is written back into the storage location 164 to await the next sync signal 124. If, upon the comparison in the device 172, the number $J_A$ is found to be at least as great as $J_p$, namely 500, the comparator 172 issues a "yes" command, which is a logic 1 signal, along a line 178 to initiate an intentional test of the bindery system. This logic 1 signal is applied to an input terminal 180*a* of an OR gate 180. A resulting output signal from the OR gate 180 is transmitted through the input/output interface at 98 of the computer 10, then along a test command line 182 to an intentional fault shift register 184 in the programmable controller 12. See FIG. 2A. The output signal from the OR gate 180 also resets the contents of the storage location 164 to 0, i.e. it resets the number $J_A$ to 0, in preparation for starting a new counting sequence.

Figure 3:
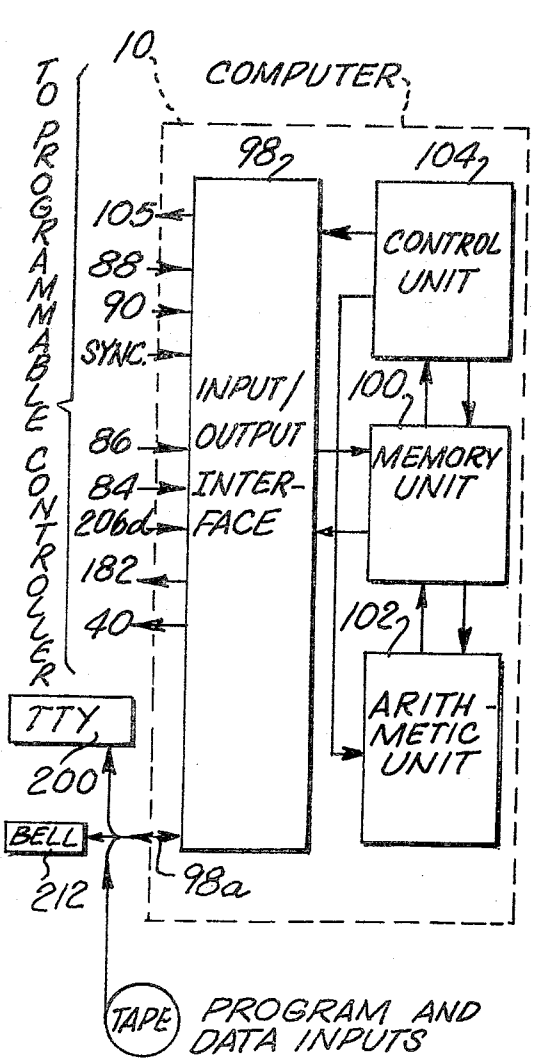
FIG. 3 is a simplified block diagram of the computer which cooperates with the programmable controller of FIGS. 2A and 2B to control the collating machine of FIG. 1.

An intentional fault test can also be initiated manually by the operator at the teletype unit 200, FIG. 3. To call manually for an intentional fault test, the operator types the word "TEST" at the keyboard of the teletype unit 200. This information enters the input/output interface 98 of the computer at the terminal 98*a* and results in a logic 1 signal appearing at a second input terminal 180*b* of the OR gate 180. A logic 1 signal is therefore produced at the output terminal 180*c*, which produces an intentional fault test command on the test command line 182 and also resets the number $J_A$ to 0, as was described above in connection with the occasional automatic intentional fault testing of the bindery system.

The test command on the line 182 puts a logic 1 signal into a first stage 186 of the intentional fault shift register 184. At the time of the next cycle of the collating machine 14, a pulse on the line 82 from the polyphase clock 64 shifts the data contents of every stage of the intentional fault shift register 184 to the next following stage. Thus the test command in the first shift register stage 186 is transferred to a second shift register stage 188. Upon the next cycle of the collating machine 14 the test command is shifted to another shift register stage 190, which corresponds to the first hopper 18*a* of the collating machine 14.

At the same time the test command is transmitted from the output of the shift register stage 188 along a line 192 to one input 196*a* of an OR gate 196. This enters an intentional fault signal, i.e. an intentional "bad book" signal, into the first stage 60*a* of the misses shift register 60. Another input 196*b* of the OR gate 196 is provided for entering unintentional "bad book" signals produced by the miss detector switch 24*a* of the first hopper 18*a*.

The first two stages 186, 188 of the intentional fault shift register 184 have no counterpart among the hoppers 18 of the collating machine; each of the other stages 190 etc. of the intentional fault shift register 184 does correspond to a hopper. The stages 186, 188 are provided in order to enter the intentional fault signal early enough to be able to include the first hopper 18*a* in the intentional fault test.

To illustrate the operation of the intentional fault shift register 184, a typical hopper, namely the second hopper 18*b*, is discussed herein. When the intentional fault signal arrives at a shift register stage 193, corresponding to the second hopper, the signal is read out along a line 201 which leads to an inverting input terminal 204*a* of an AND gate 204, as shown in FIG. 2A. This signal prevents the AND gate 204 from transmitting a miss signal from the line *e* through *a* second input 204*b* of the AND gate 204 to an output terminal of the AND gate 204. Consequently, no miss signal is transmitted along the cables 84 to the computer when an intentional fault test causes a miss signal from the caliper switch 24*b*. The computer does not count the intentional faults when counting the numbers $A_M$, $A_M'$ etc. of unintentional faults for the purpose of determining whether or not to shut down the machine.

Similarly, no miss signal is transmitted through the phase delay device 56*b* and the OR gate 58*b* into the shift register stage 60 *b*. That shift register stage has a fault signal already; the intentional fault signal that was previously introduced into the shift register 60 at the first stage 60*a* was shifted into stage 60*b*.

The intentional fault signal in the shift register stage 198 is also transmitted to an input terminal 206*a* of an AND gate 206, where it is compared with test data derived over the line e from the miss caliper switch 24*b* of the second hopper 18*b*. The AND gate 206 is a comparator; when an intentional fault signal in the shift register stage 60*b* is inhibiting the feeding of a signature from the hopper 18*b*, the caliper switch 24*b* closes and produces a logic 1 signal at an input 206*b*, which is an inverting input terminal of the AND gate 206. Thereupon, the gate 206 produces a logic 0 at its output terminal 206*d*, signifying that the hopper 18*b* passed the intentional fault test.

If instead the caliper switch 24*b* malfunctions, or the inhibit control system fails to inhibit feeding, the switch 24*b* fails to close, and therefore produces a logic 0 signal at the terminal 206*b*. The comparator 206 then produces a logic 1 output signal at its output cable 206*d*. This logic 1 output signal is transmitted to the computer to show that the hopper 18*b* of bindery machine has failed an intentional fault test. A faulure can result from a misadjusted or otherwise defective feed sensor, by failure of an inhibit mechanism to inhibit a feed, defects in wiring, or other causes.

The comparator 206 also has an input terminal 206*c* which prevents the comparator, by means of a logic 0 signal thereon, from producing a fault signal at the cable 206*d* when the corresponding hopper 18*b* is programmed not to feed a signature. The signal for the input terminal 206*c* is derived from the junction of the switch 48*b* and the relay 50*b* as shwon in FIG. 2B. Similar comparators are provided for other hoppers.

In the memory 100 of the computer, a failure of an intentional fault test at a hopper is recorded by storing a logic 1 failure signal in a memory location such as the locations 216 (for the first hopper) and 218 (for the 32*d* hopper).

In a similar manner an inspection stage 208 of the shift register 184 is connected to an input of a comparator 210, whose output 210*a* provides an error signal to the computer 10 if the inspection station photocell 38 following the rejection station 28 fails to indicate the absence of a book when a book is intentionally absent there. When the inspection station 32 thus fails an intentional fault test, a logic 1 is stored in a memory address symbolized by a block 220 of FIG. 4. The presence of an intentional fault signal in the shift register inspection stage 208 also inhibits the production of a wrongful absence signal, by disabling the gate 92 by means of a signal on a line 214, which is connected to an inverting input 92*c* of the gate 92, FIG. 2A.

When one or more of the hoppers and/or reject inspection station fail the intentional fault test, the computer 10 rings a bell 212, FIG. 3, because of data in the storage locations 216, 220, 222, etc. The operator then turns on the teletype unit 200, which automatically types out a list of the failing stations. The system is preferably arranged so as not to automatically stop the machine 14 upon such a failure.

The intentional fault testing system described above is employed also for testing inspection devices that follow other rejection stations at binding and trimming machines that are associated with the collating machine 14. The intentional fault testing system operates in the same way there as was described in connection with the inspection station 32. A data storage location 222, FIG. 4, is provided for storing an intentional fault test failure signal from a trimmer inspection station.

Figure 5:
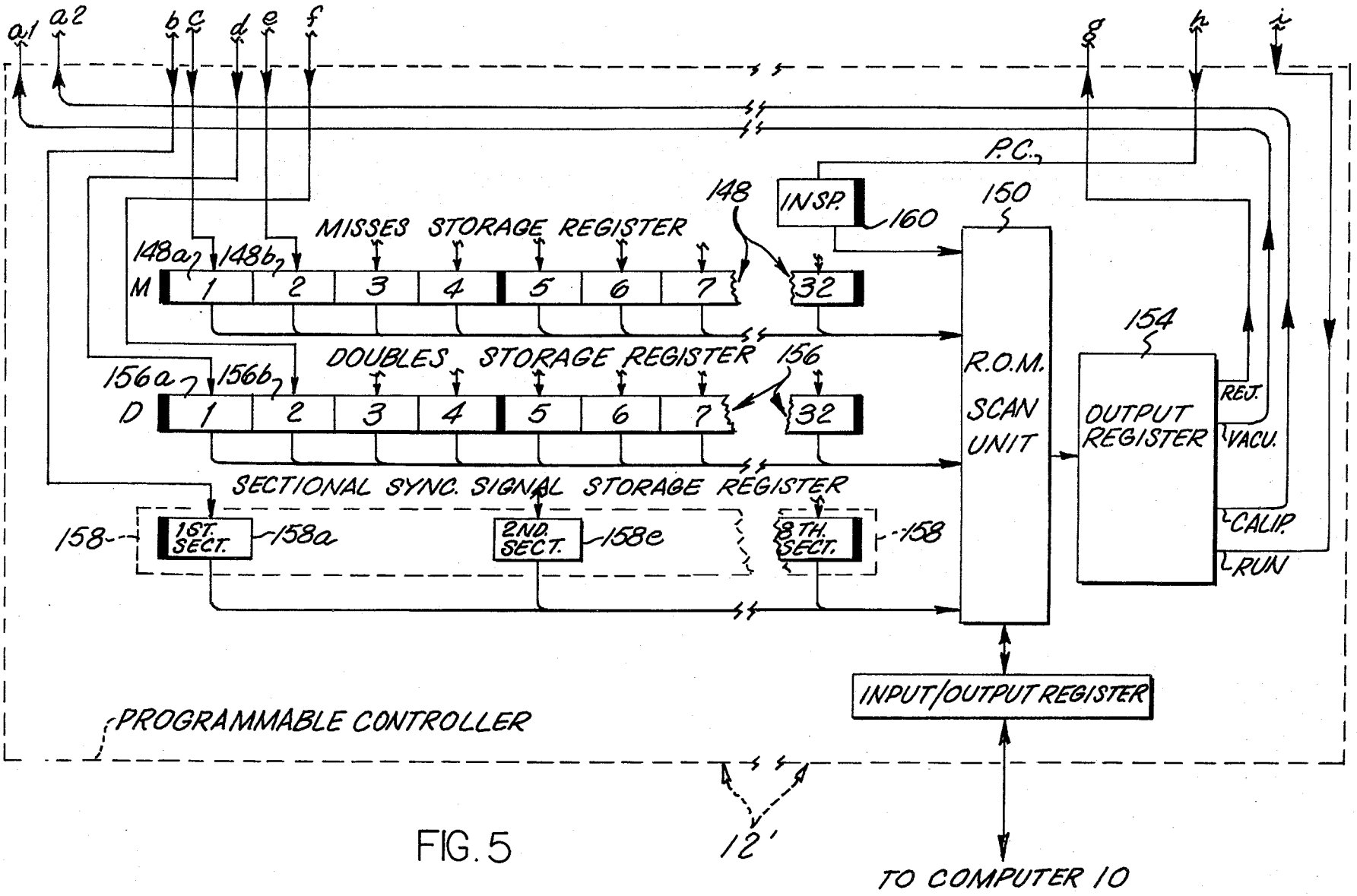
FIG. 5 is a block diagram of a second embodiment of a portion of the apparatus, in which the computer performs some of the operations that were performed in the first embodiment by the programmable controller.

A second preferred embodiment of the invention is shown in part in FIG. 5, in which more of the functions of the collating apparatus are controlled by software in the computer 10. The programmable controller 12' of FIG. 5, which replaces the programmable controller 12 of the first preferred embodiment, is drawn so as to receive correspondingly labelled cables and lines *a*1, *a*2, *b, c, d, e, f, g, h,* and *i* from FIG. 1. Thus in the second embodiment FIG. 5 replaces FIGS. 2A and 2B. FIGS. 1, 3, and 4 are applicable to both the first and second embodiments.

In the second preferred embodiment, the programmable controller 12' receives signals from the collating machine and stores them in storage registers, from which the data are read out periodically by a scanning unit and transmitted to the computer 10, which then determines control signals, and transmits the control signals back to the programmable controller 12', which in turn sends them to the collating machine 14. The programmable controller 12' receives input signals from the miss switches 24, the doubles switches 26, the synchronizing device or devices 62, and from the inspection photocell 38. For example, signals from the miss switch 24*a* of the first hopper are transmitted on a line c to a first stage 148*a* of a misses storage register 148 in the programmable controller 12', and signals from the miss switch 24*b* of the second hopper are connected by way of a line e to a second stage 148*b* of the misses storage register 148, FIG. 5. A read-only memory scan unit 150 scans the stages 148*a*, 148*b*, etc., of the misses storage register 148 to read the data sequentially therefrom.

The scan unit 150 is a read-only memory unit having very high noise immunity, and is capable, because of semi-permanent internal programming, of performing sequential operations under its own control. The read-only memory scan unit 150 and other devices of the programmable controller 12' are well known in the prior art. A typical commercial programmable controller of this type is being manufactured by Digital Equipment Corporation of Maynard, Mass., and is known as model PDP-14. Methods for programming the read-only memory unit of the programmable controller 12' are also well known.

The array of misses data that is stored in the misses storage register 148 is periodically transmitted through the read-only memory scan unit 150 and through an input/output register 152 to the computer 10. In the computer 10 these data are utilized under the control of program instructions which were previously entered into memory addresses 106 of the memory unit 100 by a software program. The computer determines the proper behavior of the feed devices 20*a*, 20*b*, 20*c*, and determines whether or not to enable each of the miss switches 24 and doubles switches 26 upon each machine cycle, and determines whether or not to actuate the reject actuator 30 and the run contactor 80. Instructions of this sort that are generated by the computer 10 are transmitted to the input/output register 152 of the programmable controller 12', and, under the control of the read-only memory scan unit 150, are connected to an output register 154 of the programmable controller. The output register 154 applies control signals to the lines *a*1, *a*2, *g,* and *i* to control the feed devices 20, to enable the malfunction switches 24, 26, to operate the rejection actuator 30, and to trip the run contactor 80 respectively.

The construction and operation of a doubles storage register 156 is similar to that of the misses storage register 148 described above. Signals produced by the doubles switches 26*a*, 26*b*, etc., are entered into respective stages 156*a*, 156*b*, etc., of the doubles storage register 156. The scan unit 150 sequentially scans the data contents of the doubles storage register 156 at least once for each cycle of collating machine operation and transmits the data which it reads successively therefrom, to an input/output register 152 and thence to the computer 10. Data from the doubles storage register 156 are taken into account along with the data from the misses storage register 148 by the computer 10, in determining and controlling the proper behavior of the collating machine 14. Hopper data such as misses and doubles data are stored in portions, which are not shown, of the memory unit 100 of the computer 10, in a manner similar to their storage in the registers 148, 156.

A sectional synchronizing signal storage register 158 is also included in the programmable controller 12'. It periodically receives synchronizing signals from the synchronizing device 62 on a line *b*, which it enters into a data storage stage 158*a*. If only one synchronizing device 62 is employed to serve all 32 hoppers of the collating machine, only the first stage 158*a* of the storage register 158 receives signals upon each cycle of the collating machine 14. If instead, as is preferred, a separate synchronizing device, such as device *s'* of hopper No. 5, is provided for each four-hopper section of the collating machine 14, then signals are periodically provided by these additional synchronizing devices also, and are stored in additional stages such as a stage 158*e* of the sectional sync storage register 158. The separate synchronizing devices are necessary when each four-hopper section is out-of-phase with the other four hopper sections, as is the case in the preferred embodiment.

The data stored in the sync register 158 are frequently and periodically scanned by the read-only memory scan unit 150, and transmitted through the input/output register 152 to the computer 10 for the purpose of synchronizing the command signals which are subsequently issued from the computer 10.

The photocell 38 at the inspection station 32 produces signals which are transmitted on a line *h* to an inspection data storage stage 160 of the programmable controller 12'. This binary data is also periodically read from the storage stage 160 by the scanning unit 150, and transmitted to the computer 10. The computer takes this photocell data into account, along with data from the misses storage register 148 and the doubles storage register 156, to determine whether or not the reject station 28 is operating properly, and hence whether or not to stop the collator 14. In the second preferred embodiment the computer performs the same logic operations with regard to the inspection station 32 that were provided by the logic units 92, 94 and 96 of the first embodiment. Just as in the first embodiment, a stop signal is produced when the rejection actuator 30 erroneously rejects a book which should not have been rejected, or erroneously retains a book which should have been rejected. Thereupon, in the second preferred embodiment, a command is issued to the programmable controller 12' from the computer 10 which makes the output register 154 issue a stop command signal on the line *i* to trip the run contactor 80 to stop the collating machine. If desired, the number of faulty operations of the rejection station 28 can be counted in the inspection data portions 142, 144 of the computer 10.

In the second preferred embodiment the intentional fault shift register 184 of the first embodiment is replaced by a software shift register, which is merely a program subroutine in the computer 10. When an intentional fault test command is produced as described above in connection with the elements 162, 164, 172, 174, 180 of FIG. 4, the test command is entered into the software shift register, and is shifted by the synchronizing pulses 124 to keep track of the fault test chain space as that space proceeds through the bindery system.

Fewer interconnecting lines are required to the input/output interface 98 of the computer 10, FIG. 5, in the second embodiment because the scanning unit 150 multiplexes the data passing between the computer 10 and the programmable controller 12'.

Software is required for programming the computer 10, including software to perform those functions of the second embodiment that were performed by the programmable controller 12 in the first embodiment. The preparation of the software for performing such clearly defined functions is well within the knowledge of those skilled in the art of programming process control computers and general purpose computers, and will not therefore be elaborated here.

What is claimed is:

1. A system for detecting the malfunctioning of sensors in a bindery system for producing a book composed of a plurality of signatures and comprising a gatherer conveyor and means for delivering a book component comprising at least a portion of a book to said conveyor, control means for enabling delivery of said book component by said delivery means, a sensor responsive to delivery of said book component and providing an output indicative of whether or not said book component was delivered and producing a fault indication when said book component is not delivered in response to enabling by said control means, test means connected for selectively providing an intentional test command signal for commanding a fault of said delivery means such that said book component is not delivered when said control means enables delivery, comparator means for comparing the output of said sensor to the output of said test means for providing a signal upon said sensor failing to properly indicate a fault when said test means commands a fault whereby said signal indicates a malfunctioning of said sensor.

2. A system according to claim 1 wherein said delivery means comprises a signature feed means for feeding a signature onto said conveyor, and said book component comprises a signature.

3. A system according to claim 2 further comprising counting means coupled to said sensor for counting fault indications produced by said sensor and means coupled to said counting means for inhibiting said counting means in response to a test command signal, whereby said counter does not count commanded faults.

4. A system according to claim 1 wherein said signature delivery means comprises a plurality of hoppers for feeding signatures each having a sensor cooperating therewith, said test means is connected for providing a test command signal to each hopper, and said comparator means includes means for comparing the output of each sensor to said test command signal.

5. A system according to claim 4 wherein said conveyor comprises a plurality of chain spaces and comprising means for establishing machine cycles during which chain spaces are each in registration with a hopper, signatures are fed in response to enabling by said control means and said conveyor is advanced such that chain spaces are in registration with next hoppers, whereby stacks are formed in chain spaces, and wherein said test means comprises counting means for producing a test command signal during one machine cycle out of a preselected number of machine cycles.

6. A system according to claim 5 further comprising a book rejection station at said conveyor and downstream of said hoppers, circuit means responsive to said sensor for actuating said reject station to reject a stack from a chain space in registration with a hopper at which a fault signal is produced when said chain space reaches said book rejection station, and second sensor means having an output and located at an inspection station downstream of said book rejection station for determining the presence or absence of stacks in the chain spaces during a subsequent machine cycle, and wherein said comparator means further comprises means for storing a test command signal produced when the chain space is in registration with a hopper for which a fault is commanded for comparison to the output of said second sensor means when the chain space is in registration with said inspection station for indicating whether said book rejection station rejected a stack in response to commanding of a fault.

7. A bindery system according to claim 4 further comprising means for producing a signal identifying a sensor providing an output not indicative of a fault in comparison to a test command signal.

8. A bindery system according to claim 1 wherein said delivery means comprises a book rejection station at said conveyor operable to reject a stack in response to a fault signal, said book component comprises a stack delivered by collating means upstream of said book rejection station, and said sensor comprises a book inspection station downstream of said book rejection station.

9. A method of inspection of a bindery system for producing a book composed of a plurality of signatures and comprising a gatherer conveyor and means for delivering a book component comprising at least a portion of a book to said gatherer conveyor, control means for enabling delivery of said book component by said delivery means, and sensor means responsive to delivery of said book and providing an output indicative of whether or not a book was delivered and producing a fault indication when said book component is not delivered in response to enabling by said control means comprising the steps of:

producing a test command signal, applying said test command signal to inhibit delivery by said delivery means in response to enabling by said control means, and monitoring the output of said sensor means with respect to said test command signal for determining whether said sensor provided an output indicative of a fault in response to commanding of a fault whereby the failure of said sensor means to indicate a fault signifies a malfunctioning thereof.

10. A method according to claim 9 for inspecting a bindery system wherein said delivery means comprises a plurality of hoppers for feeding signatures each having sensor means coupled thereto and said conveyor comprises chain spaces and said bindery system operates in machine cycles during which chain spaces are each in registration with a hopper, signatures are fed in response to enabling by said control means, and the conveyor advances such that chain spaces are in registration with next hoppers, whereby stacks are formed in each chain space, and wherein the step of producing a test command signal comprises providing the test command signal during one of a preselected number of machine cycles.

11. A method according to claim 10 and further comprising the step of incrementing a count in response to fault indications produced by at least one of said sensor means and inhibiting said incrementing which would otherwise result from a fault commanded by said test command signal.

12. A method according to claim 10 further comprising the step of, in response to the monitoring step, producing a signal which identifies of each of said sensor means not indicating a fault in response to a test command signal.

13. A method according to claim 10 for inspecting a bindery system further comprising a reject station downstream of said hoppers for rejecting a stack from a chain space in registration with a hopper at which a fault indication is produced when the chain space reaches said reject station and an inspection station comprising further sensor means downstream of said reject station for providing an output indicative of the presence or absence of a stack in the chain space, further comprising the step of comparing an output of the further sensor means in response to inspection of the chain space with respect to said test command signal for determining whether said reject station rejected the stack from the chain space in response to commanding of a fault.

* * * * *